US006257308B1

(12) United States Patent
Huang

(10) Patent No.: US 6,257,308 B1
(45) Date of Patent: Jul. 10, 2001

(54) STRAINER SCREEN SUPPORT FRAME

(76) Inventor: Wen-Chin Huang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/668,630

(22) Filed: Sep. 21, 2000

(51) Int. Cl.[7] ..... A47H 3/00
(52) U.S. Cl. ..... 160/369; 160/371
(58) Field of Search ..... 160/369, 371, 160/380, 381, 179; 55/490, 492, 503, 508, 511

(56) References Cited

U.S. PATENT DOCUMENTS 4,946,484 * 8/1990 Monson et al. ..... 55/507 X
4,986,050 * 1/1991 Brunetti et al. ..... 52/488
5,809,730 * 9/1998 Renz ..... 52/506.09
5,833,727 * 11/1998 Skarsten ..... 55/502 X
5,993,311 * 11/1999 Feller et al. ..... 454/187
6,070,383 * 6/2000 Jeanseau ..... 52/506.05

* cited by examiner

*Primary Examiner*—David M. Purol

(57) ABSTRACT

A strainer screen support frame has a main shelf, a blocking panel, and an upper pressing panel. The main shelf has an upper plate, a separation plate, a guide bevel plate, a blocking plate, a click recess, and a base seat. The upper plate has a first groove. The separation plate has a second groove and a downward bar. A slot is formed between the blocking plate and the base seat. The base seat has a third groove and a fourth groove. The blocking panel has a downward protruded block. The upper pressing panel has a connection edge, a downward panel, a first click groove, and a positioning groove. A screen frame is disposed between the separation plate and the blocking plate. The blocking panel is inserted in the slot.

4 Claims, 7 Drawing Sheets

STRAINER SCREEN SUPPORT FRAME

BACKGROUND OF THE INVENTION

The present invention relates to a strainer screen support frame. More particularly, the present invention relates to a strainer screen support frame which can engage with a screen frame quickly.

A screen frame is often used for supporting a screen net. The screen net covers an air outlet of an air conditioning equipment in a dustless room or a building. The screen frame is fixed on a ceiling. It is cumbersome to detach the screen frame in order to replace the screen net.

SUMMARY OF THE INVENTION

An object of the present invention is to provide a strainer screen support frame which can engage with a screen frame quickly and the screen frame can be replaced easily.

Accordingly, a strainer screen support frame comprises a main shelf, a blocking panel, and an upper pressing panel. The main shelf has an upper plate, a separation plate, a guide bevel plate, a blocking plate, a click recess, and a base seat. The upper plate has a first groove. The separation plate has a second groove and a downward bar. A screen frame receiving spacing is formed between the guide bevel plate and the blocking plate. A slot is formed between the blocking plate and the base seat. The base seat has a third groove communicating with the slot, and a fourth groove. The blocking panel has a downward protruded block. The upper pressing panel has a connection edge, a downward panel, a first click groove, and a positioning groove. The upper pressing panel is disposed on the upper plate. The first click groove of the upper pressing panel engages with the click recess of the main shelf. A clearance is formed between the connection edge and the upper plate. A screen frame is disposed between the separation plate and the blocking plate. A gel is disposed on an upper portion of the screen frame. The blocking panel is inserted in the slot. An upper positioning panel has a second click groove engaging with the positioning groove of the upper pressing panel.

DETAILED DESCRIPTION OF THE INVENTION

Figure 1:
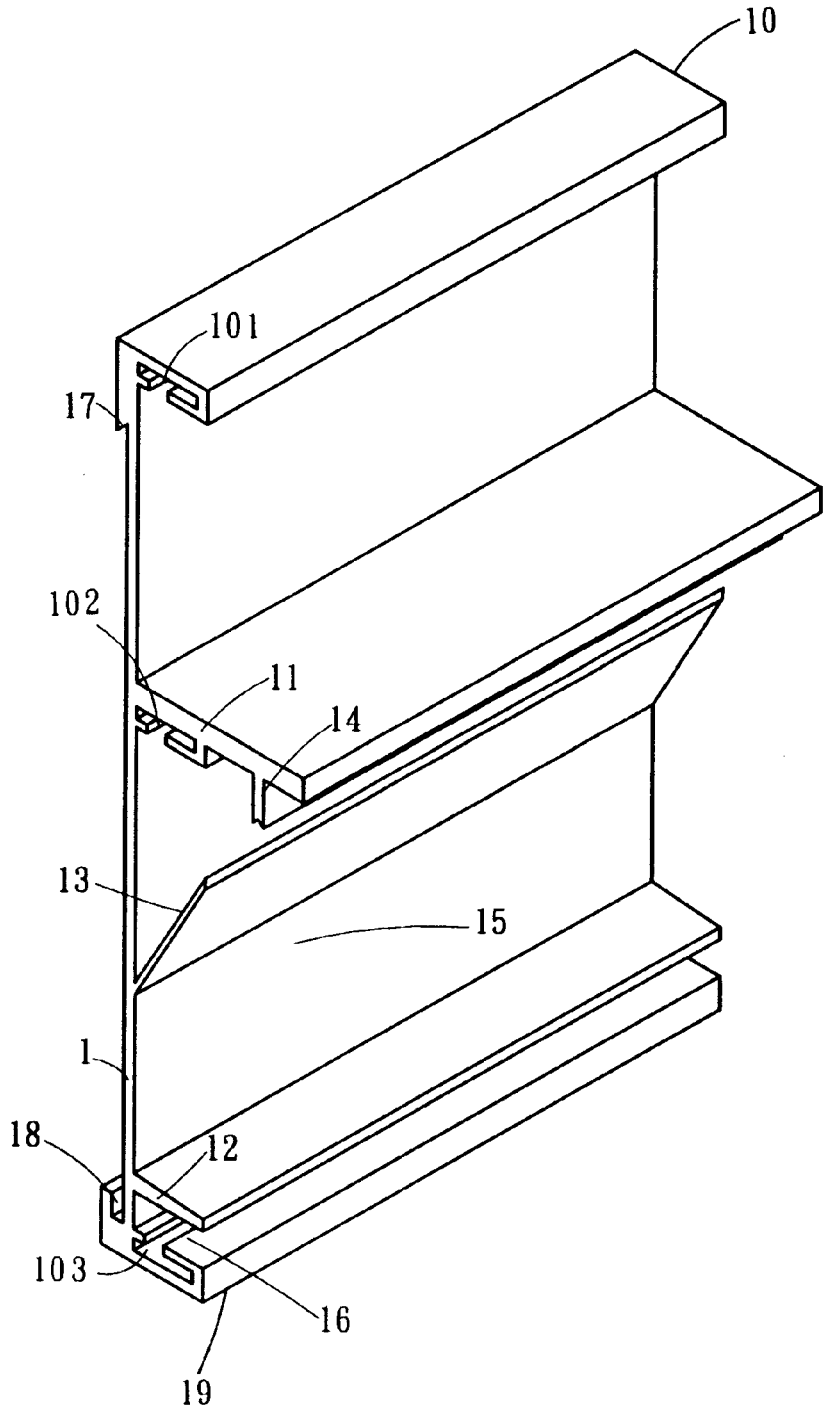
FIG. 1 is a perspective view of a main shaft of a preferred embodiment in accordance with the present invention.
Figure 2:
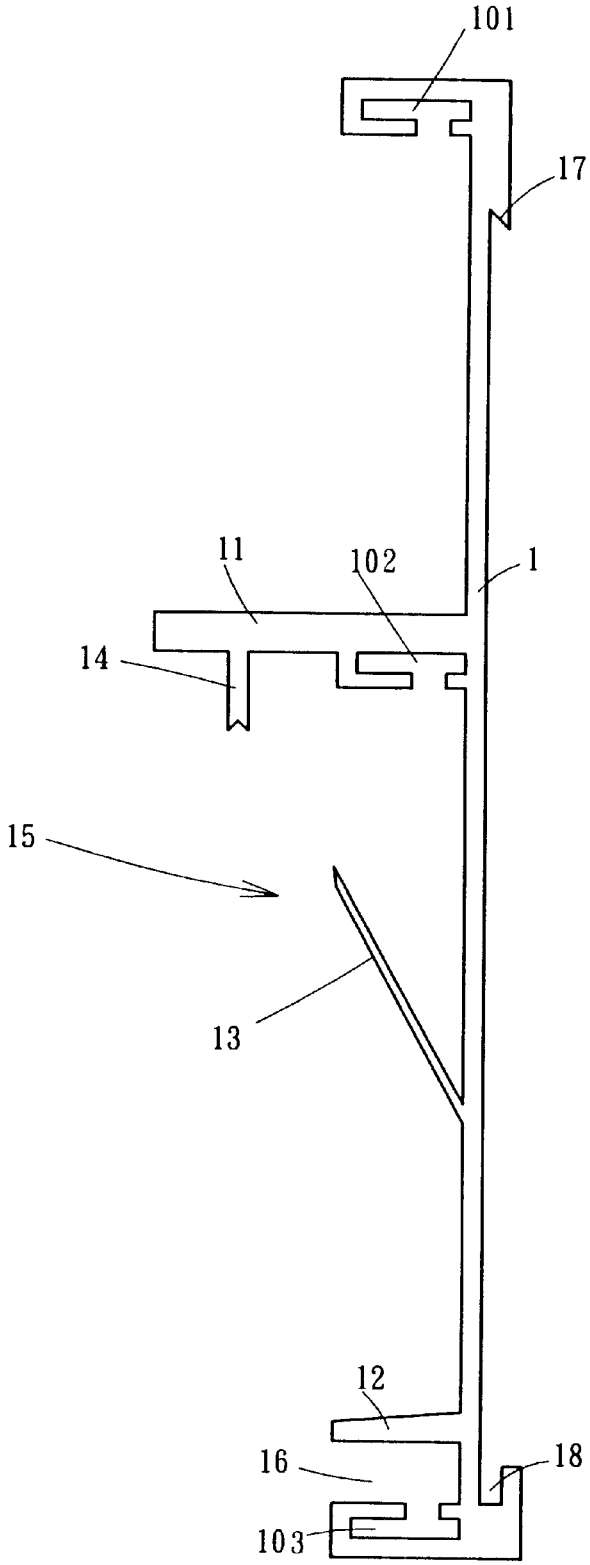
FIG. 2 is an elevational view of a main shaft of a preferred embodiment in accordance with the present invention.

Referring to FIGS. 1 to 4, a first strainer screen support frame comprises a main shelf 1, a blocking panel 2, and an upper pressing panel 4.

The main shelf 1 has an upper plate 10, a separation plate 11, a guide bevel plate 13, a blocking plate 12, a click recess 17, and a base seat 19.

The upper plate 10 has a first groove 101.

The separation plate 11 has a second groove 102 and a downward bar 14.

A screen frame receiving spacing 15 is formed between the guide bevel plate 13 and the blocking plate 12.

A slot 16 is formed between the blocking plate 12 and the base seat 19.

The base seat 19 has a third groove 103 communicating with the slot 16, and a fourth groove 18.

The blocking panel 2 has a downward protruded block 20.

The upper pressing panel 4 has a connection edge 41, a downward panel 42, a first click groove 40, and a positioning groove 44.

The upper pressing panel 4 is disposed on the upper plate 10. The first click groove 40 of the upper pressing panel 4 engages with the click recess 17 of the main shelf 1. A clearance 43 is formed between the connection edge 41 and the upper plate 10.

A screen frame 3 is disposed between the separation plate 11 and the blocking plate 12. A gel 31 is disposed on an upper portion of the screen frame 3.

The blocking panel 2 is inserted in the slot 16.

Figure 3:
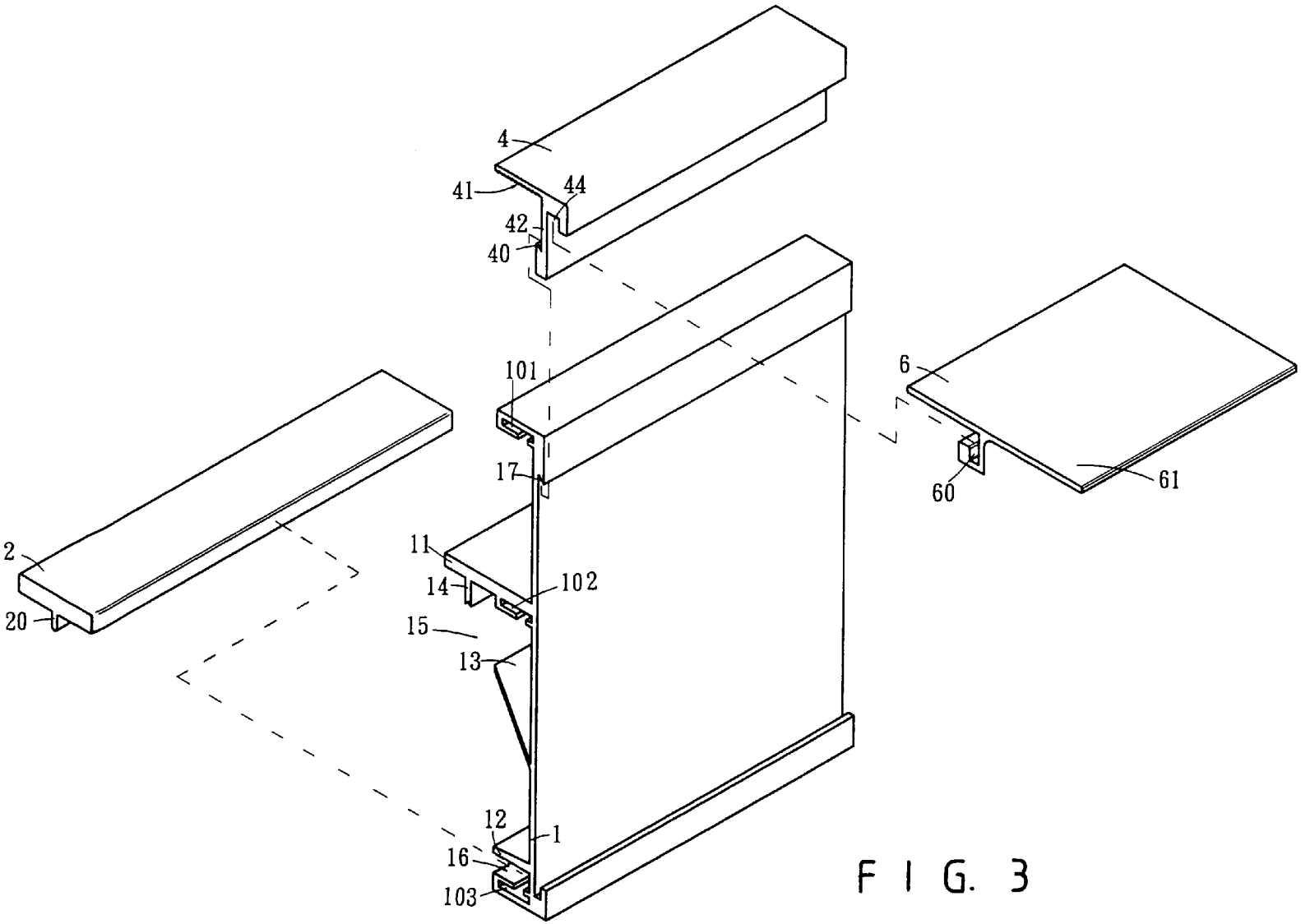
FIG. 3 is a perspective exploded view of a strainer screen support frame of a first preferred embodiment in accordance with the present invention.
Figure 4:
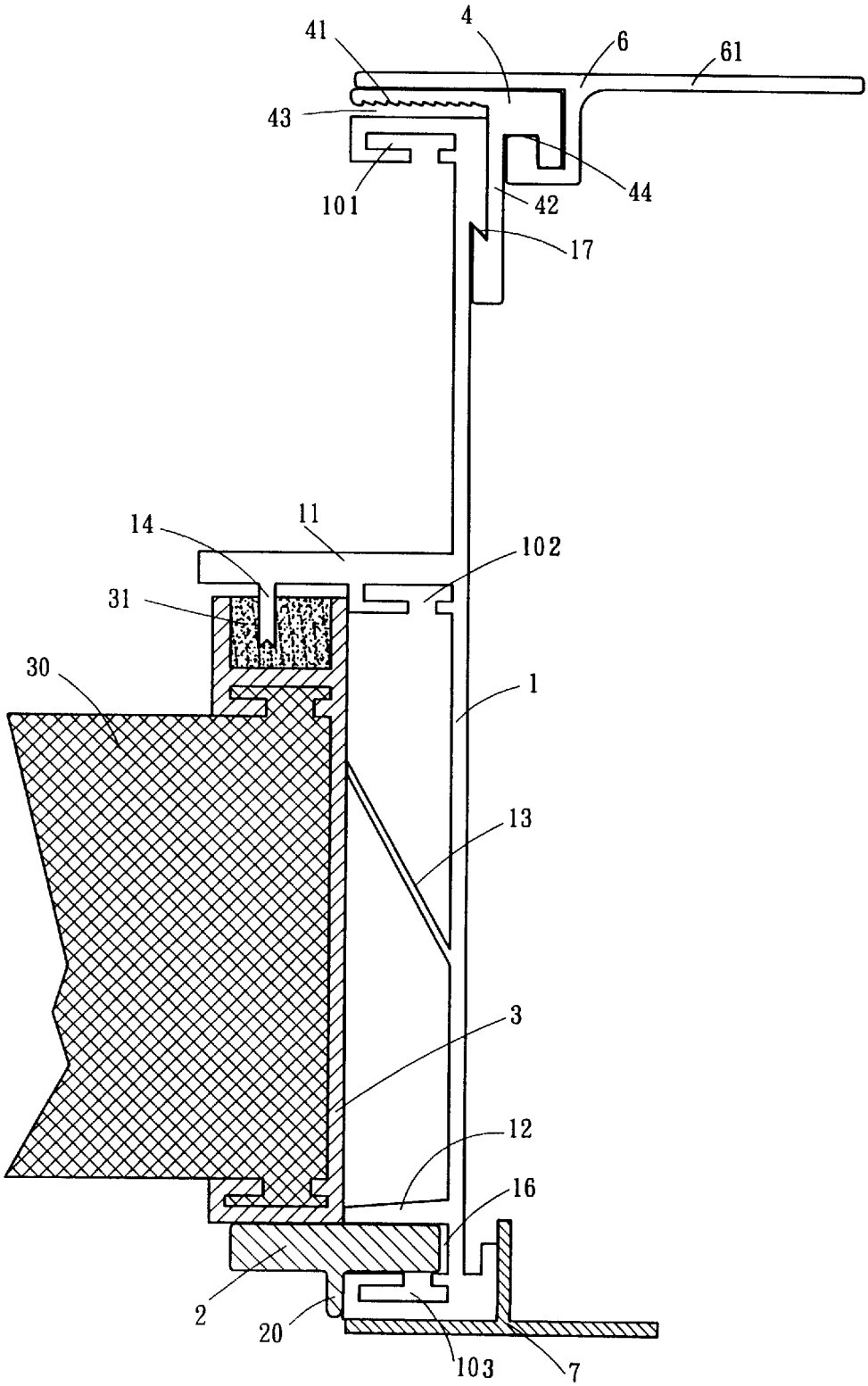
FIG. 4 is a partially sectional view of a strainer screen support frame of a first preferred embodiment in accordance with the present invention.

Referring to FIGS. 3 and 4, an upper positioning panel 6 has a second click groove 60 engaging with the positioning groove 44 of the upper pressing panel 4 and a top face 61 abutting a ceiling (not shown in the figures). A steel panel 7 is disposed on a bottom of the base seat 19.

Figure 5:
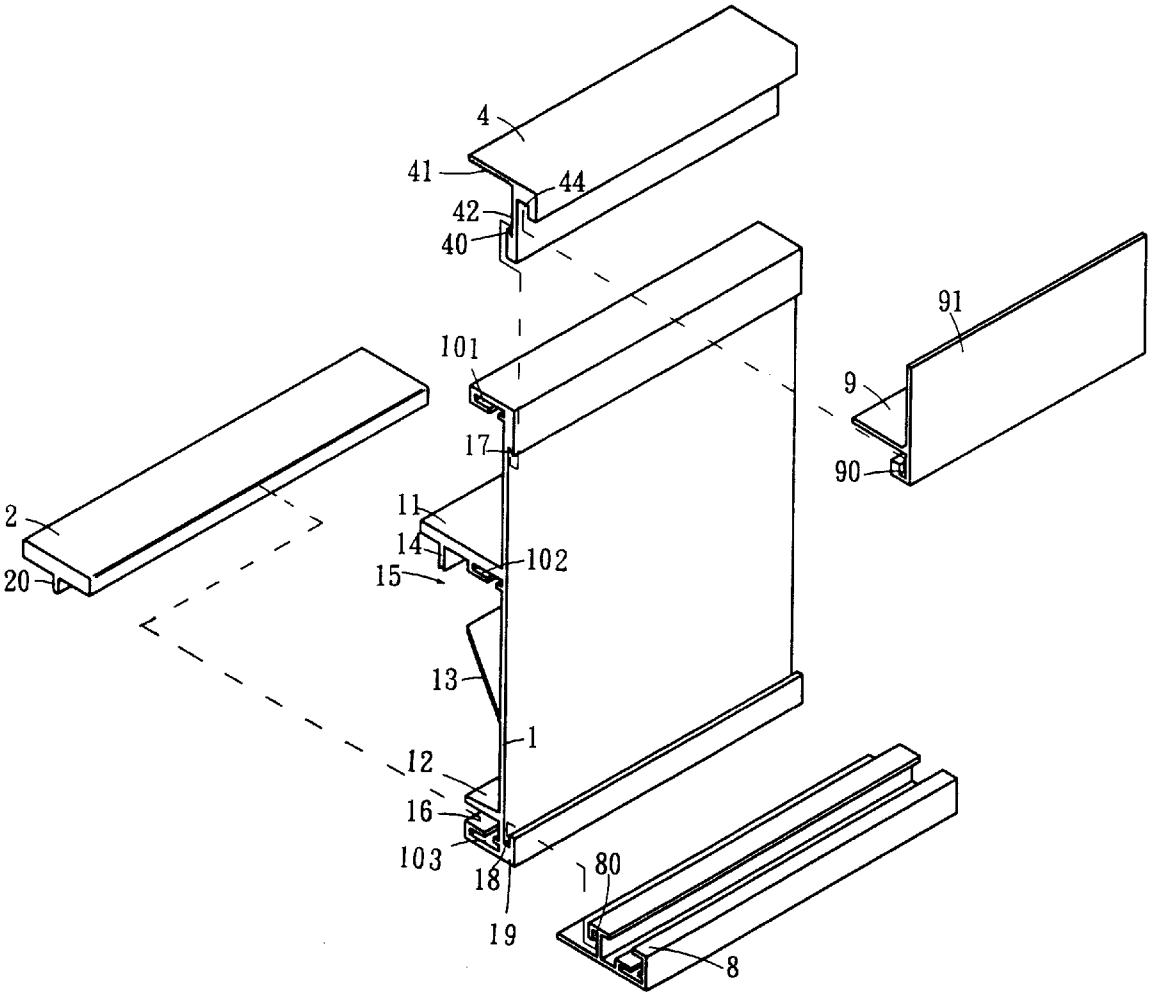
FIG. 5 is a perspective exploded view of a strainer screen support frame of a second preferred embodiment in accordance with the present invention.
Figure 6:
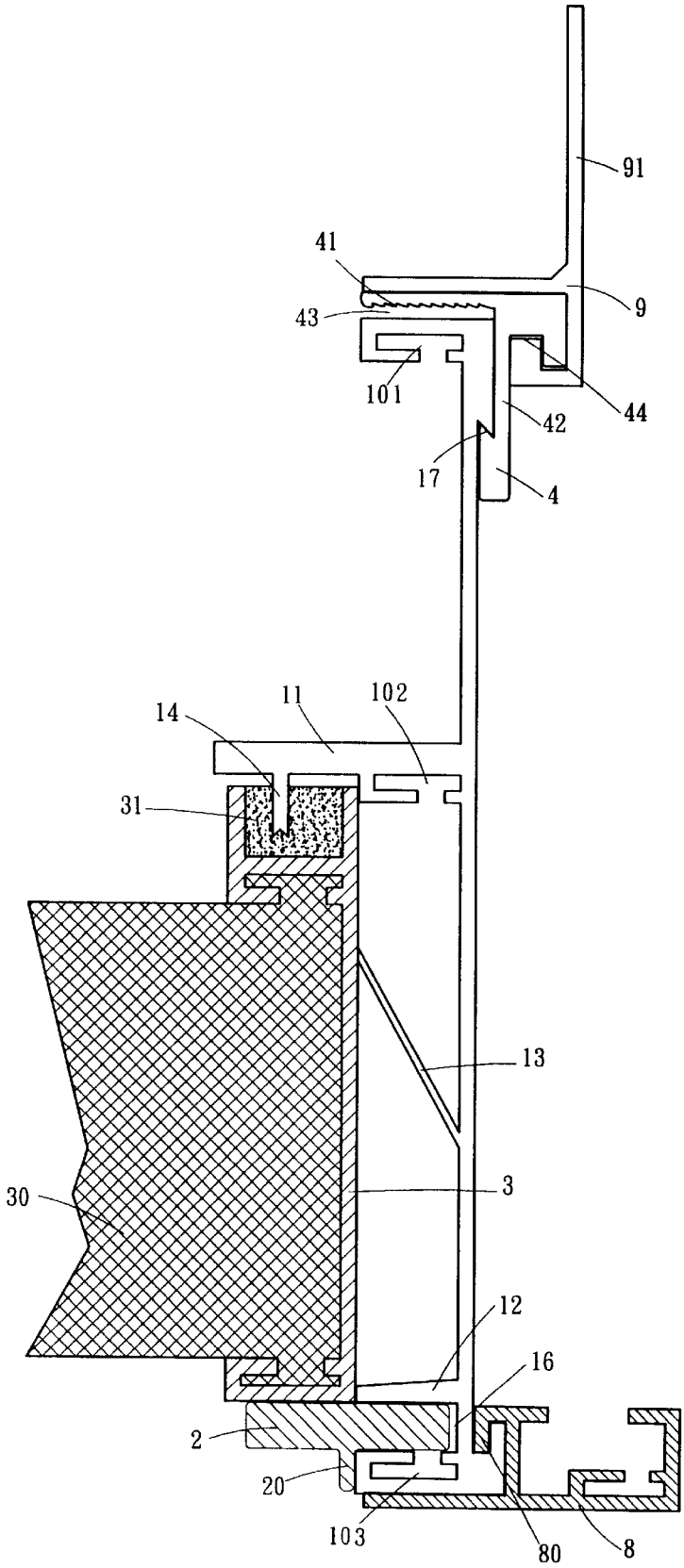
FIG. 6 is a partially sectional view of a strainer screen support frame of a second preferred embodiment in accordance with the present invention.
Figure 7:
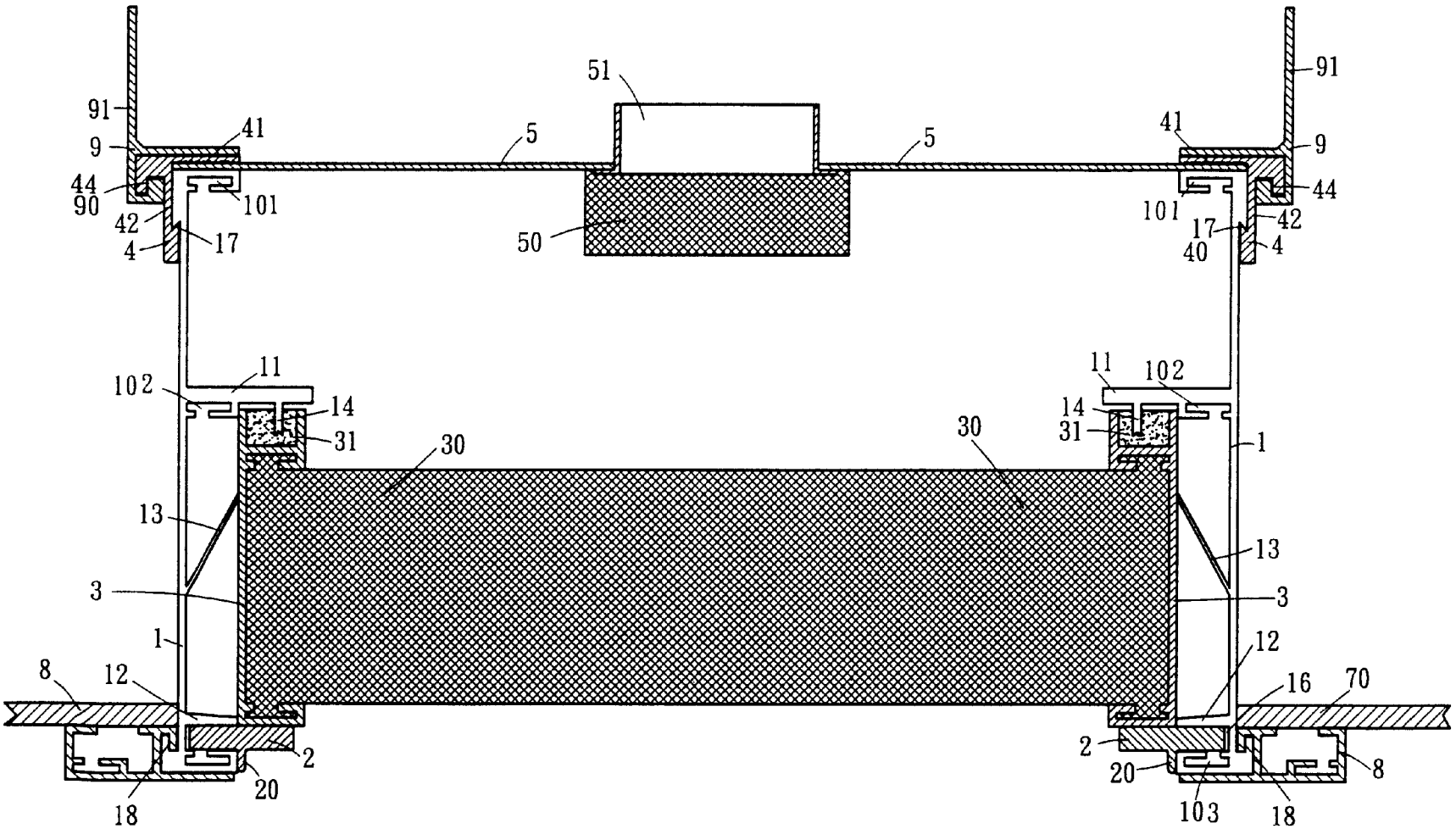
FIG. 7 is a sectional assembly view of a strainer screen support frame of a second preferred embodiment in accordance with the present invention.

Referring to FIGS. 5 to 7, an angle positioning panel 9 replaces the positioning panel 6. The angle positioning panel 9 has a longitudinal plate 91 and a positioning recess 90 engaging with the positioning groove 44 of the upper pressing panel 4.

The longitudinal plate 91 abuts a wall (not shown in the figures).

A base panel 8 is disposed on a bottom of the base seat 19. The base panel 8 has a guide groove 80 engaging with the fourth groove 18 of the base seat 19.

The invention is not limited to the above embodiment but various modification thereof may be made. Further, various changes in form and detail may be made without departing from the scope of the invention.

I claim:

1. A strainer screen support frame comprising:

a main shelf, a blocking panel, and an upper pressing panel, the main shelf having an upper plate, a separation plate, a guide bevel plate, a blocking plate, a click recess, and a base seat, the upper plate having a first groove, the separation plate having a second groove and a downward bar, a screen frame receiving spacing formed between the guide bevel plate and the blocking plate, a slot formed between the blocking plate and the base seat, the base seat having a third groove communicating with the slot, and a fourth groove, the blocking panel having a downward protruded block, the upper pressing panel having a connection edge, a downward panel, a first click groove, and a positioning groove, the upper pressing panel disposed on the upper plate, the first click groove of the upper pressing panel engaging with the click recess of the main shelf, a screen frame disposed between the separation plate and the blocking plate, and the blocking panel inserted in the slot.

2. The strainer screen support frame as claimed in claim 1, wherein an upper positioning panel has a second click groove engaging with the positioning groove of the upper pressing panel.

3. The strainer screen support frame as claimed in claim 1, wherein an angle positioning panel has a longitudinal plate and a positioning recess engaging with the positioning groove of the upper pressing panel.

4. The strainer screen support frame as claimed in claim 1, wherein a base panel is disposed on a bottom of the base seat.

* * * * *